United States Patent [19]

Crosbie

[11] 4,276,713

[45] Jul. 7, 1981

[54] PERCOLATING BUBBLE GENERATOR

[76] Inventor: Scott C. Crosbie, 4349 Brookside Ave., Minneapolis, Minn. 55435

[21] Appl. No.: 117,946

[22] Filed: Feb. 4, 1980

[51] Int. Cl.[3] ..... A63H 33/28

[52] U.S. Cl. ..... 46/8; 46/7; 73/861.65

[58] Field of Search ..... 46/6, 7, 8, 408; 73/861.65

[56] References Cited

U.S. PATENT DOCUMENTS

| | | | |
|---|---|---|---|
| 2,553,388 | 5/1951 | Steiner et al. | 46/8 |
| 2,587,895 | 3/1952 | Quinn, Jr. et al. | 46/7 |
| 2,711,612 | 6/1955 | Wister | 46/7 |
| 2,828,579 | 4/1958 | Schwerbel et al. | 46/6 |
| 3,093,925 | 6/1963 | Greene | 46/8 |
| 3,831,448 | 8/1974 | Kors et al. | 73/861.65 |
| 3,925,923 | 12/1975 | La Fata et al. | 46/7 |

*Primary Examiner*—Gene Mancene
*Assistant Examiner*—Michael J. Foycik
*Attorney, Agent, or Firm*—Warren A. Sturm

[57] ABSTRACT

A percolating bubble generator in which a stream of air is utilized to form a succession of bubbles and launch them into the air. The stream of air under pressure utilized to effect the objects of this invention is divided into two streams; a main stream of air is directed by a nozzle through a cylindrical percolation chamber, while a second stream is passed through a tube into a bubble-forming liquid contained in a lower portion of the percolation chamber, such lower portion having an outlet opening for the discharge of bubbles formed by percolating the liquid. The main air stream passes out the outlet of the percolation chamber, causing expulsion of bubbles formed in the lower portion of the percolation chamber.

5 Claims, 4 Drawing Figures

FIG. 1.
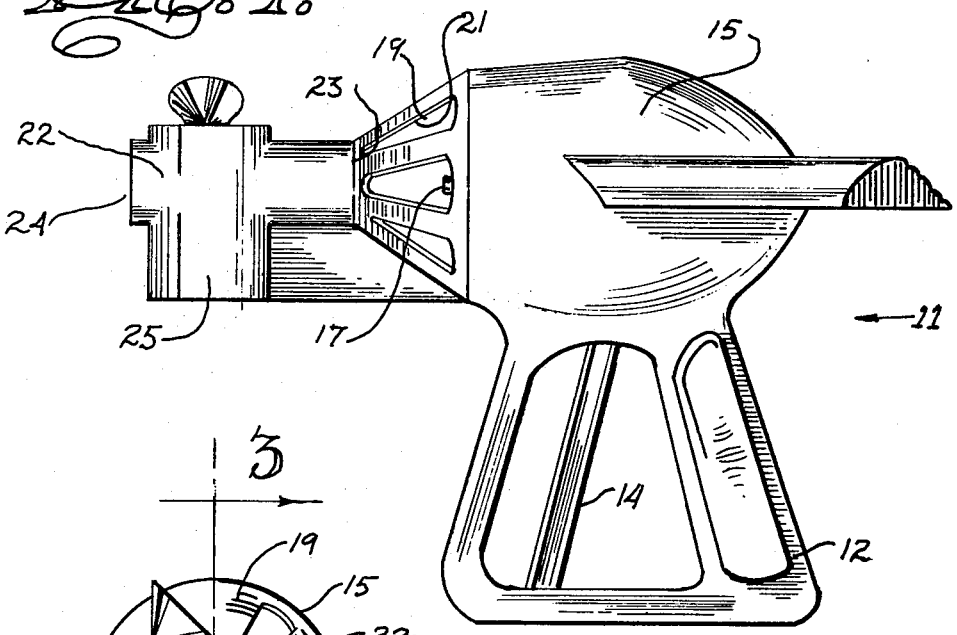
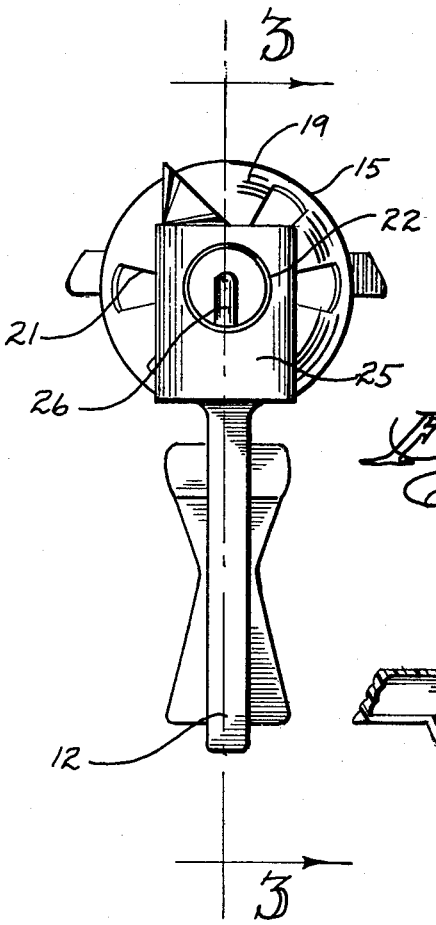
FIG. 2.
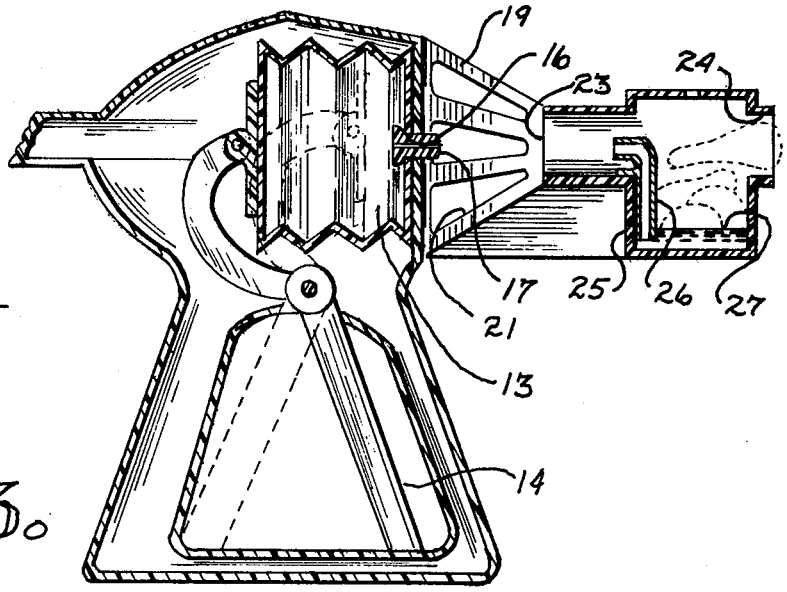
FIG. 3.

PERCOLATING BUBBLE GENERATOR

BACKGROUND OF THE INVENTION

This invention is concerned with a generation of a continuous stream of bubbles using a single source of air under pressure that is divided to provide a percolation function to form bubbles within a percolation chamber and to launch the bubbles from an outlet of the percolation chamber in a continuous stream and in effect recombining the stream of air under pressure to the delight and amusement of the operator.

The prior art with which this invention is concerned is amply illustrated by the following cross section of various and sundry devices and apparatus for generating bubbles; Horton, U.S. Pat. No. 727,952, May 12, 1903; Sturm, Jr. U.S. Pat. No. 2,542,100, Feb. 20, 1951; Quinn, U.S. Pat. No. 2,587,895, Mar. 4, 1952; Wister, U.S. Pat. No. 2,711,612, June 28, 1955; Panico, Jr. U.S. Pat. No. 3,060,626, Oct. 30, 1962; Gibbons, U.S. Pat. No. 3,323,250, June 6, 1967; Jakubowski, U.S. Pat. No. 3,473,253, Oct. 21, 1969; Blessner, U.S. Pat. No. 3,733,736, May 22, 1973; and Hackell, U.S. Pat. No. 3,952,447, Apr. 27, 1976.

From the time span over which the above noted patents issued, it may be seen that the toy and/or amusement arts have remained active in the proliferation of patents that have successively issued concerning the gentle art of forming bubbles for the amusement of all.

SUMMARY OF THE INVENTION

The present invention is concerned with an improved bubble generator that may be used in a number of environments limited only by the imagination of the user. The present invention utilizes a percolation chamber in combination with a means for dividing the stream from a source of air under pressure into two parts, the first being used to effect the percolation of liquid within a percolation chamber and the second used to recombine with the first stream at the outlet of the percolation chamber to launch a substantially constant stream of bubbles outwardly of the outlet of the percolatin chamber.

The percolation chamber is generally cylindrical in shape but may be formed of other configurations having an outlet disposed for a horizontal attitude of discharge of a stream of bubbles while including a tubular section that is vertically oriented so that one stream of air is always passed through a bubble forming liquid, such as a soap solution, to initiate the percolation bubble forming process for the recombination of the streams of air at the outlet of the percolation chamber.

It is therefore an object of this invention to provide an improved bubble generating apparatus utilizing the features of dividing a source of air under pressure into two streams, using one of the streams to percolate a bubble forming liquid in a chamber having an outlet and recombining the two streams of air at the outlet of the percolation chamber to launch a stream of bubbles in the desired attitude and direction from the generator.

BRIEF DESCRIPTION OF THE DRAWINGS

FIG. 1 is a side elevational view of a device in the form of a gun;

FIG. 2 is an end view of the device shown in FIG. 1;

FIG. 3 is a view taken along line 3—3 of FIG. 2; and

FIG. 4 is a top view of the outer portion of the device.

DESCRIPTION OF THE PREFERRED EMBODIMENT

Figure 7:
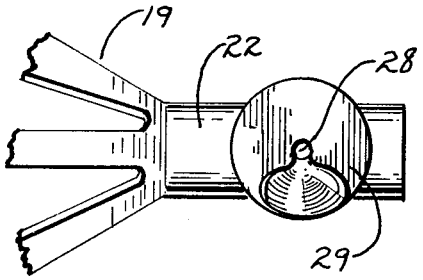

Referring to FIGS. 1—4 of the drawings, my invention is shown in the form of a gun 11 having a handle 12 and trigger 14 operatively connected to a bellows 13 contained within housing 15, as shown in FIG. 3. Bellows 13 includes an outlet 16 in which is positioned a suitably configured nozzle 17. Housing 15 has conical portion 19 with aperture 21 disposed adjacent nozzle 17.

A percolation chamber 22 is shown connected to conical portion 19 and is generally cylindrical in shape and includes an inlet aperture 23 and an outlet 24, and lower portion 25. A percolation tube 26 is shown disposed substantially in coaxial alignment with nozzle 17 and extends downwardly to a point near the bottom of the lower portion 25 of the percolation chamber 22 to lie beneath the level of bubble forming liquid 27. Percolation chamber 22 is provided on its top surface with an orifice 28 and a funnel-like memmber 29 for receiving bubble-forming liquid for charging the percolation chamber with suitable amounts of bubble-forming liquid 27 and may be used, as shown in FIG. 4, to receive a substantial quantity of bubble-forming liquid in a slightly rotated attitude and to then gradually introduce the bubble-forming liquid into percolation chamber 22 through orifice 28.

In operation, after bubble-forming liquid has been poured into lower portion 25 of chamber 27, the trigger 14 is manually operated to direct a stream of air through nozzle 17 and into chamber 22, where it is divided into a main stream passing directly through chamber 22, and a second stream which enters tube 26 and passes through the bubble-forming liquid to form bubbles. The main air stream passes out the outlet 24, thereby drawing out bubbles formed in lower portion 15.

Conical portion 19, having apertures 21, allows aspiration while air is being directed from the nozzle into percolation chamber 22. Preferably, the upper end of tube 26 is spaced apart from the end of nozzle 17, and is axially aligned therewith. The distance apart of nozzle 17 and tube 26 can be varied according to the size of bubbles desired. Also, the diameter of tube 26 is substantially lesser than that of chamber 22, such that the main air stream is substantially greater in volume than that passing through tube 26.

I claim:

1. A bubble generating apparatus comprising:

a hand holdable housing having a source of air under pressure;

a chamber mounted horizontally on the housing and having axially aligned, spaced-apart inlet and outlet openings of a first cross-sectional dimension and a lower portion for receiving liquids, the liquid receiving portion having an outlet for discharging bubbles into the interior of the chamber;

nozzle means of a substantially lesser cross-sectional dimension and being aligned with said inlet opening, said nozzle and said inlet and outlet openings being open to the ambient atmosphere around said chamber so that a stream of air from said nozzle is directed through said nozzle, said inlet opening, said chamber and said outlet opening; and tube means running upwardly from the bottom of the liquid receiving portion of the chamber, and terminating with an open end facing said inlet opening, whereby a portion of the air stream is directed through the tube means into the fluid receiving portion of said chamber to cause formation of bubbles, which are subsequently drawn out of the chamber by the air stream exiting through said outlet opening.

2. The bubble generating apparatus of claim 1 wherein the liquid receiving lower portion of the chamber is disposed toward the outlet end thereof.

3. The bubble generating apparatus of claim 2 wherein the nozzle and the upper end of the tube means are in axial alignment and are substantially spaced apart.

4. The bubble generating apparatus of claim 1 wherein the source of air under pressure is a bellows operated by a trigger.

5. The bubble generating apparatus of claim 1 additionally comprising an aperture on the upper portion of the chamber above the liquid receiving portion thereof, and a funnel-shaped member disposed thereat for receiving bubble-forming liquid.

* * * * *

UNITED STATES PATENT AND TRADEMARK OFFICE

CERTIFICATE OF CORRECTION

PATENT NO. : 4,276,713
DATED : July 7, 1981
INVENTOR(S) : Scott C. Crosbie

It is certified that error appears in the above-identified patent and that said Letters Patent are hereby corrected as shown below:

In column 2, line 31 delete numeral "27" and insert therefor -- 22 --

Signed and Sealed this

*Fifteenth* Day of *September 1981*

[SEAL]

*Attest:*

GERALD J. MOSSINGHOFF

*Attesting Officer* *Commissioner of Patents and Trademarks*